United States Patent [19]

Hayashi et al.

[11] 4,052,959

[45] Oct. 11, 1977

[54] ELECTROPHOTOGRAPHIC APPARATUS

[75] Inventors: Toshio Hayashi; Kazuo Goto; Osamu Haruyama, all of Tokyo, Japan

[73] Assignee: Ricoh Co., Ltd., Tokyo, Japan

[21] Appl. No.: 653,875

[22] Filed: Jan. 30, 1976

[30] Foreign Application Priority Data

Jan. 31, 1975 Japan ..... 5013567

[51] Int. Cl.[2] ..... G03G 15/10

[52] U.S. Cl. ..... 118/644; 118/262; 118/652; 118/659; 355/10; 308/36.1

[58] Field of Search ..... 118/637, DIG. 23, 262, 118/644, 652, 659; 355/10; 427/15; 308/36.1

[56] References Cited

U.S. PATENT DOCUMENTS

| | | | |
|---|---|---|---|
| 3,881,789 | 5/1975 | Kornylak | 308/36.1 |
| 3,885,176 | 5/1975 | Cunningham | 308/36.1 |
| 3,907,423 | 9/1975 | Hayashi et al. | 118/DIG. 23 |
| 3,923,351 | 12/1975 | Frost | 308/36.1 |

*Primary Examiner*—Henry S. Jaudon
*Attorney, Agent, or Firm*—Frank J. Jordan

[57] ABSTRACT

A roller is rotatable so that its surface moves in a direction opposite to a photoconductive drum to remove excess liquid developer from the drum. Rolling contact bearings are mounted on opposite ends of a shaft supporting the roller and have a diameter which is slightly larger than that of the roller so that when the bearings are pressed against the drum a slight clearance is maintained between the surfaces of the drum and the roller. The bearings are sealed and filled with a lubricant which does not degrade the liquid developer if mixed therewith. A wiper contacts the roller to remove developer pricked up thereby from the drum. Wipers are further disposed in contact with the drum upstream of the bearings to remove developer from the drum in these areas prior to contact with the bearings.

8 Claims, 6 Drawing Figures

ELECTROPHOTOGRAPHIC APPARATUS

The present invention generally relates to electrophotographic copying apparatus of a semimoist development and transfer type and, more particularly, to apparatus for removing excess developing liquid from the surface of a photoconductive drum after an electrostatic latent image formed thereon has been developed.

A known system for the removal of excess liquid developer from the surface of a photoconductive drum comprises a roller arranged such that it is held in pressing engagement with the drum surface to squeeze the excess developer therefrom. Another known system blows a stream of air onto the drum surface to achieve the same result (an air knife system). Corona discharge is utilized for removal in still another known system.

The system using a roller is disadvantageous in that the roller when brought into contact with the surface of the drum will abrade the developed image on the photoconductive surface to possibly deteriorate the quality of the image. Drawbacks inherent in the air-knife system are that air if contaminated will contaminate the image when blown thereagainst. The developer will also be splashed by the air, and the image will be distorted since toner particles will be unevenly carried away by the air from the drum surface. The corona discharge system is not fully acceptable since difficulty is experienced in the removal of excess developer when the electrophotographic process is carried out at high speed.

It is therefore an object of the present invention to provide electrophotographic apparatus comprising means for accurately and uniformly removing excess liquid developer from the surface of a photoconductive drum which does not degrade the quality of the image.

It is another object of the present invention to provide electrophotographic apparatus comprising a roller, the surface of which is rotatable opposite to the surface of a photoconductive drum in close proximity thereto and accurately maintained relative to the drum surface by bearings having a diameter slightly larger than that of the roller and being in rolling contact with the drum, the bearings being sealed and lubricated with a substance which does not degrade the quality of the image even if mixed with liquid developer.

The above and other objects, features and advantages of the present invention will become clear from the following detailed description taken with the accompanying drawings, in which.

Figure 1:
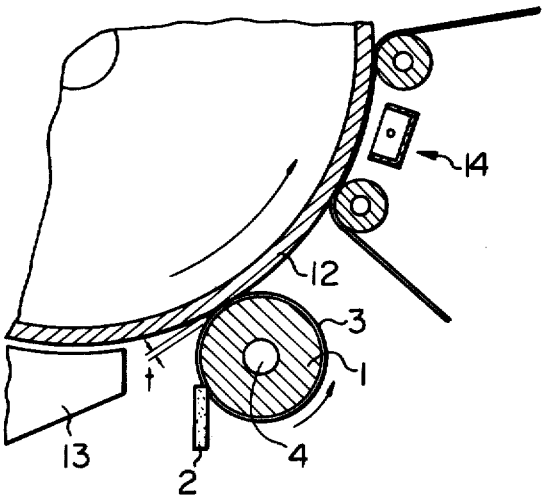
FIG. 1 is a fragmentary elevation of electrophotographic apparatus embodying the present invention.

Referring now to FIG. 1, a roller 1 and a photoconductive drum 12 both rotate counterclockwise so that the surface of the roller 1 nearest to the drum 12 moves in a direction opposite to that of the image portion of the photoconductive drum 12. The roller 1 is disposed in the vicinity of a developing station 13 and interposed between the developing station 13 and a transfer station 14 with a gap $t$ defined between the adjacent surfaces of the drum 12 and the roller 1.

Figure 2:
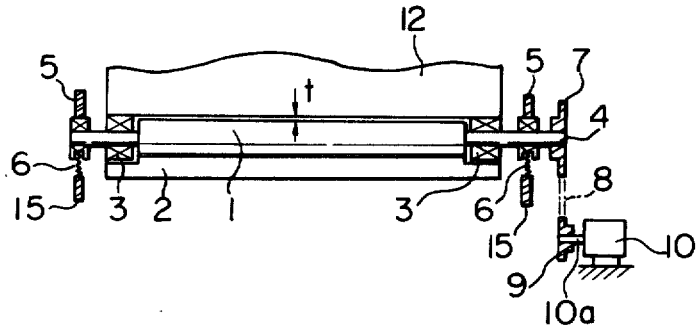
FIG. 2 is a fragmentary longitudinal section of the apparatus shown in FIG. 1.

As viewed in FIG. 2, a pair of bearings 3 each having a diameter larger than the diameter of the roller 1 by 2I are mounted on a shaft 4 fixed to the roller 1 concentrically with the roller 1 so as to maintain the aforementioned gap $t$. The shaft 4 has its opposite ends rotatably supported by another pair of bearings 5. The bearings 5 are subject to the force of corresponding coiled compression springs 6 disposed between the bearings 5 and stationary members 15 of the electrophotographic copying apparatus. The biasing force of the springs 6 urges the outer peripheries of the bearings 3 into pressing engagement with non-image areas at the ends of the surface of the drum 12 as shown so that the gap $t$ is constantly maintained between the roller 1 and the drum 12 due to the difference between the outer diameter of the bearings 3 and the diameter of the roller 1.

The shaft 4 carries at one end thereof a sprocket wheel 7 which is driven from a sprocket wheel 9 through a chain 8. The sprocket wheel 9 is mounted on an output shaft 10a of a variable-speed motor 10. The roller 1 is rotated at a speed determined by the surface speed of the drum 12 to provide optimum efficiency in the removal of excess developing liquid. The excess developer on the surface of the drum 12 is removed by the roller 1, and the developer adhering to the roller 1 is removed by a wiper of blade 2 which is disposed in an appropriate excess developer collecting vessel (not shown). To provide a copy as dry to the touch as is obtainable in a dry development process with the above-described system, the gap $t$ is made as small as possible although the roller 1 must remain clear of the developed image. Such a small gap $t$ is required particularly in a high-speed copying apparatus, and the gap $t$ must be maintained at about 50 microns with precision.

The precision of the gap $t$ principally depends on the precision of the bearings 3 associated with the roller 1. It is difficult, however, to maintain such a uniform and small gap $t$ between the drum 12 and the roller 1 because the bearings 3, even if COLLOTYPE (trade name) bearings formed of a highly wear resistant resinous material, cannot preclude uneven wear with resultant play. A toner used for a semimoist-transfer copying apparatus in particular requires a large resinous component, and the toner particles tend to enter into the bearings. The resinous component in the toner particles will dry and rigidly adhere to the bearings when the apparatus is not in use. The resinous component once dried cannot be dispersed even when immersed in developing liquid so that the wear rate of the bearings is increased. In the worst case, the bearings will not rotate and the function of the roller 1 will be lost. The wear rate of ordinary steel ball bearings is lower than that of the COLLOTYPE bearings, but steel ball bearings are subject to toner particles entering therein which prevent rotation. The image during development is also adversely affected by the bearing lubricant, which leaks out of the bearings and contaminates the developing liquid.

Figure 3:
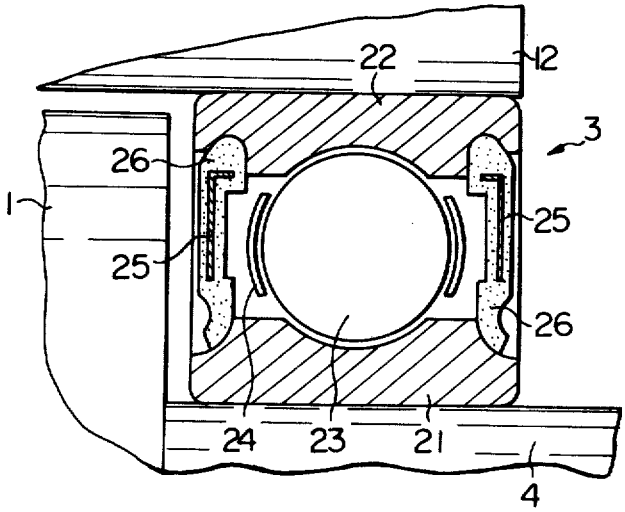
FIG. 3 is an enlarged section of a bearing used in the apparatus.

In FIG. 3, the bearings 3 each have an inner race 21 fixed to the shaft 4 on which the roller 1 is mounted and an outer race 22 pressed into rolling contact with the surface of the drum 12. Balls 23 or other suitable rolling elements are operatively disposed between the inner race 21 and the outer race 22 of the bearing 3 and retained by a retainer 24. A pair of rubber seals 26 each having a steel stiffener plate 25 embedded therein are fixed to the outer race 22 and resiliently contact the inner race 21 to maintain the space accommodating the balls 23 air-tight. With this configuration of the bearings 3, toner cannot enter therein, and the function of the roller 1 can be reliably maintained.

Figure 4:
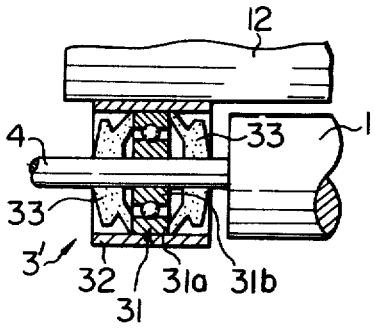
FIG. 4 is similar to FIG. 3 but shows an alternative bearing.

Another example of a bearing of the present invention is illustrated in secion in FIG. 4, and designated as 3', a ball bearing 31 is associated with a pair of V-shaped ring seals 33.

An outer race 31*a* of the ball bearing 31 is fixed to the inner peripheral surface of a casing 32 of the bearing 3', the outer peripheral surface of which is pressed into rolling engagement with the drum 12. The shaft 4 carrying the roller 1 thereon is fixed to an inner race 31*b* of the bearing 31. Disposed on opposite sides of the bearing 31 inside the casing 32 are the V-shaped ring seals 33, each of which is fixed to the shaft 4 and resiliently engages with the side the outer race 31*a*.

Figure 5:
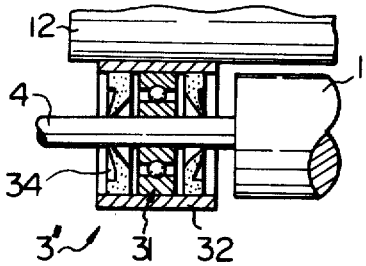
FIG. 5 is also similar to FIG. 3 but shows another alternative bearing.

Still another example of a bearing of the present invention is illustrated in FIG. 5 and designated as 3'', in which oil seals 34 are employed in place of the V-ring seals 33. Each oil seal 34 is fixed to the inner peripheral surface of the casing 32 and resiliently engages with the shaft 4. The oil seals 34 are disposed in the casing 32 on opposite sides of the bearing 31.

Although the bearing described above will prevent developing liquid from entering therein, it is advisable to provide even better protection by preventing the bearings from being exposed to the liquid.

Figure 6:
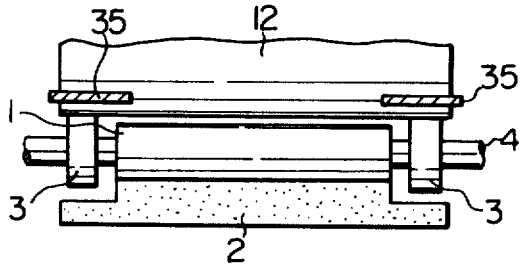
FIG. 6 is a view showing wipers for removing developing liquid from a roller of the apparatus.

Referring to FIG. 6, a pair of wipers or side blades 35 which are supportably connected to the stationary member 15 of the electrophotographic copying apparatus are provided upstream of the bearings 3 in pressing contact with the drum 12 to remove excess developing liquid from the ends of the drum 12 before the excess developing liquid on the ends of the drum 12 passes to the bearings 3.

The blade 2 engages with the entire width of the roller 1 but does not contact the bearings 3, so that the bearings 3 are free from frictional force and can rotate smoothly without damaging the surface of the drum 12. The smooth rotation of the bearings 3 is also assisted by the side blades 35 which remove developing liquid from the drum 12 surface to minimize the possibility of the liquid entering the bearings 3 and to develop a frictional force between the bearings 3 and the drum 12 surface.

A lubricant is usually used in ball bearings. Should the developing liquid enter the bearings 3 and subsequently flow out of the bearings 3 mixed with the lubricant, the lubricant would contaminate the developer to eventually affect the image during development. A series of experiments was performed to formulate a lubricant which will not adversely affect the image even if mixed with liquid developer.

The lubricant must meet the following requirements:

1. Does not chemically react with liquid developer (non-affinity).
2. Does not tend to flow out of the bearings (non-dispersibility).
3. Does not interfere with the rotation of the bearings (lubricativeness).

In the experiments, lubricants of various properties were mixed with ISOPAR H (trade name) liquid developer to determine their despersibility. The experiments showed that lubricants whose base oils are organic do not disperse easily whereas those containing inorganic base oils disperse more readily. It was also found that lubricants containing inorganic base oils cannot be dispersed without difficulty in an organic based lubricant such as PERMALUB J (trade name).

The lubricants under test were introduced into a developing liquid (ISOPAR H and toner), and the mixtures were used to develop electrostatic images to determine the quality of the resultant images. It was revealed that most of the organic lubricants including PERMALUB J decrease the density of the resultant image. Although the reason for this reduction in image density could not be clarified, it was presumed that the toner particles are prevented from holding their charge by fatty acid in the organic lubricants.

The inorganic lubricants caused no reduction in image density in contrast to the organic lubricants. It was therefore concluded that lubricants having dispersibility do not adversely affect the resultant images and those without dispersibility adversely affect the images.

It will thus be appreciated that by effectively sealing the bearings 3 or preventing the bearings 3 from being exposed to developing liquid, the gap *t* between the drum 12 and the roller 1 can be maintained constant over a long period of time. It will also be appreciated that a copy sheet developed by the apparatus is dry to the touch and the bearing 3 lubricant will not adversely affect the image even if the developer enters the bearings 3 and flows out mixed with lubricant.

What is claimed is:

1. In electrophotographic apparatus having a movable photoconductive member:

a roller disposed adjacent to the photoconductive member and a rotatable in a direction so that a peripheral portion of the roller nearest to the photoconductive member moves in a direction opposite to a peripheral portion of the photoconductive member nearest to the roller;

a shaft on which the roller is fixed for unitary rotation;

two bearings supporting opposite ends of the shaft respectively, a diameter of the bearings being greater than a diameter of the roller by a predetermined value, each of the two bearings comprising: an inner race fixed to the shaft; an outer race in rolling contact with the photoconductive member; rolling elements operatively disposed between the inner and outer races; and seal means to enclose the rolling element; and a wiper engaging the photoconductive member upstream of each of the two bearings respectively.

2. The apparatus of claim 1, in which the seal means comprises a resilient seal for each of the two bearings respectively fixed to one of the inner outer races and resiliently contacting the other of the inner and outer races thereof.

3. The apparatus of claim 2, in which the resilient seal comprises an imbedded metal stiffener.

4. The apparatus of claim 1, in which the seal means comprises a resilient seal for each of the two bearings respectively fixed to the shaft and resiliently contacting the outer race thereof.

5. The apparatus of claim 1, in which the seal means comprises a resilient seal for each of the two bearings respectively fixed to the outer race thereof and resiliently contacting the shaft.

6. The apparatus of claim 1, further comprising a wiper engaging with the roller.

7. The apparatus of claim 1, further comprising a retainer for the rolling elements of each of the two bearings respectively.

8. The apparatus of claim 1, further comprising biasing means for urging the shaft in a direction such that the outer races of the two bearings contact the photoconductive member.

* * * * *